US005127294A

United States Patent [19]

Mohr

[11] Patent Number: 5,127,294

[45] Date of Patent: Jul. 7, 1992

[54] DEVICE FOR CUTTING STACKED PRODUCT IN SHEET FORM

[76] Inventor: Wolfgang Mohr, Hundshager Weg 42, D-6238 Hofheim/Taunus, Fed. Rep. of Germany

[21] Appl. No.: 619,250

[22] Filed: Nov. 28, 1990

[30] Foreign Application Priority Data

Nov. 30, 1989 [DE] Fed. Rep. of Germany ..... 3939596

[51] Int. Cl.[5] ..... B26D 7/02

[52] U.S. Cl. ..... 83/412; 83/36; 83/277; 83/419; 83/468.1; 83/468.5

[58] Field of Search ..... 83/418, 36, 934, 704, 83/705, 410.7, 411.7, 412, 206, 277, 423, 35, 419, 468.5, 468.1

[56] References Cited

U.S. PATENT DOCUMENTS

| | | | |
|---|---|---|---|
| 2,329,890 | 9/1943 | Fisher | 83/418 |
| 2,939,355 | 6/1960 | Seyison | 83/277 X |
| 3,546,990 | 12/1970 | Schneider | 83/206 X |
| 4,445,409 | 5/1984 | Mohr et al. | 83/157 |
| 4,512,227 | 4/1985 | Salvagnini | 83/277 X |
| 4,758,214 | 7/1988 | de Bin | 83/35 X |
| 4,823,662 | 4/1989 | Stolzer | 83/206 X |
| 4,850,257 | 7/1989 | Mohr | 83/93 |

*Primary Examiner*—Frank T. Yost
*Assistant Examiner*—Kenneth Peterson
*Attorney, Agent, or Firm*—James F. Mudd; Michael L. Dunn

[57] ABSTRACT

The invention relates to a device for cutting stacked product (25) in sheet form having a table (12), the surface of which has an operating area, above which there is a cutting blade (2) and a pressing beam (3), behind it a feed area to receive the product to be cut and in front of it an output area to receive the cut product, and having a forward feed apparatus for the product to be cut.

In order to avoid strenuous mechanical and ergonomically harmful work when turning the product to be cut, in particular in conjunction with the edge trimming of the product, it is proposed according to the invention to provide in the region of the feed area a gripper system (29) for turning the product to be cut in the plane of the table surface.

47 Claims, 4 Drawing Sheets

DEVICE FOR CUTTING STACKED PRODUCT IN SHEET FORM

Figure 1:
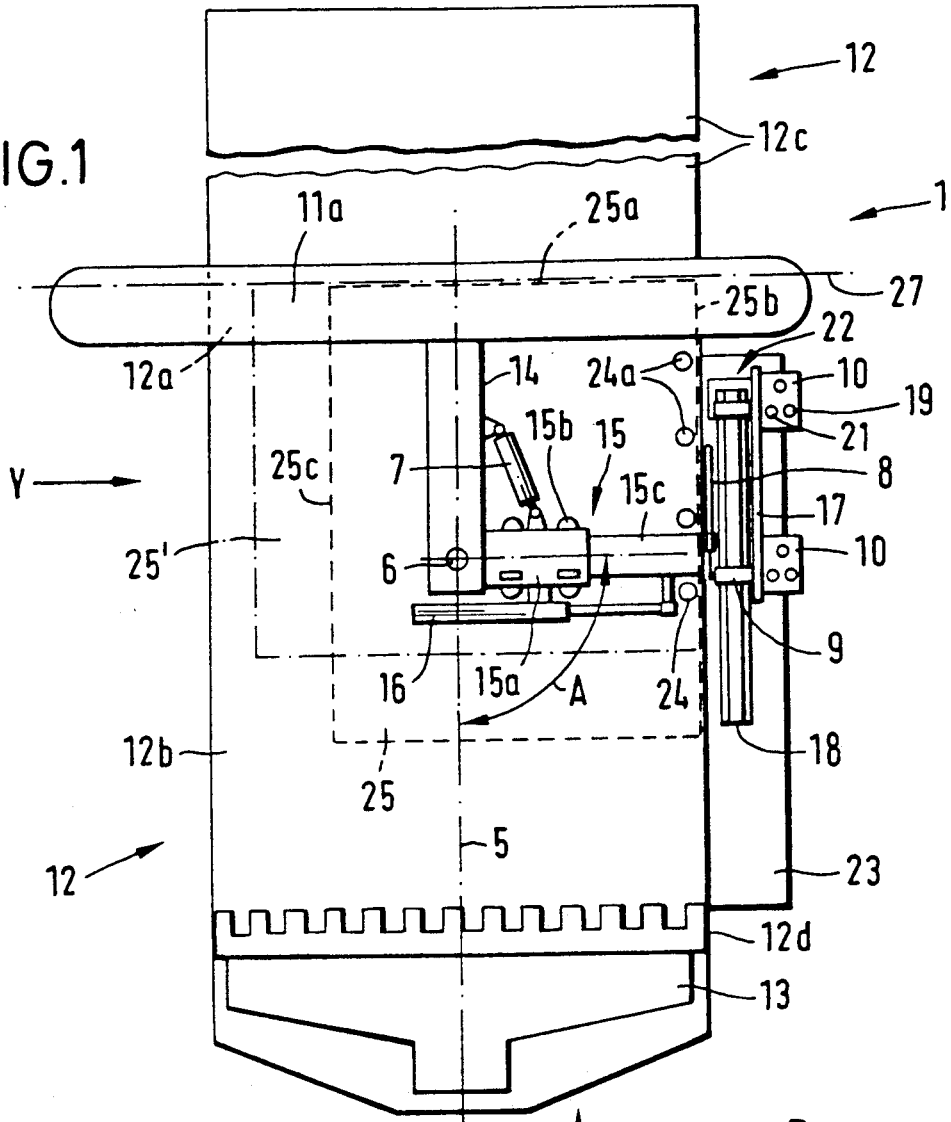

The invention relates to a device for cutting stacked product in sheet form having a table, the surface of which has an operating area, above which there is a cutting blade and a pressing beam, behind it a feed area to receive the product to be cut and in front of it an output area to receive the cut product, and having a forward feed apparatus for the product to be cut.

A device of this type is known, for example, from German Offenlegungsschrift 3,101,911. In the latter, during edge trimming the stack is customarily pulled onto the output area after an edge cut by the operator present in the region of the output area, is turned by 90° there, is pushed back onto the feed area and there is placed in a defined position below the cutting blade by means of the forward feed apparatus so that the next edge cut can take place, following which appropriate edge cuts are made until, finally, all the edges of the stack have been trimmed. An operating mode of this type requires strenuous manual work, the sequence of movements being extremely unfavourable from an ergonomic viewpoint since the operator has to pull the heavy product towards him and then turn it outside the usual arm reach envelope, that is to say with the trunk bent forwards. This applies not only for the edge cuts described but in general when it is necessary for the product to be cut to be turned within the region of the feed area.

The object of the present invention is to develop a device of the type mentioned to the extent that strenuous manual and ergonomically harmful work is avoided when turning the product to be cut, in particular in conjunction with the edge trimming of the product.

The object is achieved in that a gripper system is provided in the region of the feed area for turning the product to be cut in the plane of the table surface. The gripper system enables any work arising in the region of the feed area to be carried out fully automatically. For example, by means of the gripper system the product to be cut can be turned in conjunction with edge trimming, moreover the product to be cut can be pulled back in the direction of the forward feed unit and also advanced in the direction of the cutting blade by means of the gripper system, which results in the ordered positioning of the stack to be cut being simplified substantially. In this case, an air jet system can additionally be provided in the table, in particular in the region of the feed area, to reduce the displacement forces.

The gripper system itself should expediently have at least one pair of gripper tongs which is displaceable parallel and perpendicular to the table surface, with the gripping plane oriented parallel to the table surface. The gripper tongs thus grip the stack to be cut laterally, when using two pairs of gripper tongs they can grip the stack on one side or on opposite sides.

According to a particular embodiment of the invention, provision is made for the device to have a first support projecting over the feed area, the free end of which support receives a second support which can be swivelled parallel to the table surface and which, in turn, receives the gripper tongs in a manner so as to be displaceable perpendicular to the table surface. The first support expediently extends approximately to the centre of the feed area so that the second support only has to be slightly longer than half the length of the longitudinal extent of the feed area. In this context, it is considered to be advantageous if the second support is constructed so as to be variable in length, by which means the displacement times of the forward feed apparatus of the product to be cut can be reduced since the second support can position the stack nearer to the cutting blade during the turning of the stack and during a superimposed retraction movement of the support and a following movement of the forward feed apparatus.

In guides in the region of its free end, the second support should receive a gripper support which is perpendicular to said second support, is displaceable parallel to the table surface and in which a lifting element is mounted, to which lifting element the gripper tongs are connected. Due to the displaceable mounting of the gripper support, the gripper tongs can grip the stack to be cut at different intervals from the operating area, in particular at the centre of the stack side to be gripped. In addition, it is considered to be advantageous if two pairs of gripper tongs are connected to the gripper support, which gripper tongs are spaced apart and do not grip the stack in the centre of the stack side, but further towards the outside. The lifting element assigned to the respective gripper tongs for lowering and raising the gripper tongs should advantageously be constructed as a lifting cylinder which is charged pneumatically or hydraulically. In addition, it is, of course, also possible to displace the gripper tongs by means of a spindle or the like.

A preferred embodiment of the invention provides for the projecting support to be stationary. According to a further embodiment, provision is made for the projecting support to be displaceable parallel to the longitudinal extension of the cutting blade and the pressing beam. The projecting support can, for example, be connected to a stand receiving the cutting blade and the pressing beam. However, it is also possible instead for the projecting support to be connected to a stand arranged behind or next to the output area. Particularly in that case when the support is arranged behind the output area, the pair or pairs of gripper tongs can take over the function of the forward feed apparatus. Moreover, the first and the second supports can form a knuckle joint, to the free end of which that gripper support is preferably connected which has the two pairs of gripper tongs which are displaceable perpendicular to the table surface. The gripper system thus not only receives the function of turning the stack, but also of advancing it, and it is even possible to transfer the product to be cut from peripheral equipment to the device by means of the gripper system. If the grippers have mobility relative to one another, the gripper system can additionally receive the function of a swivelling saddle which balances out the angular position tolerances of the stack.

Each pair of gripper tongs expediently has a lower gripper jaw which is stationary in relation to the gripper tongs and an upper gripper jaw which is displaceable in relation to said gripper tongs perpendicular to the table surface by means of a lifting element, in particular a lifting cylinder. In order to ensure that the product to be cut can be gripped securely by means of the gripper tongs, the table should have in the feed area a trough to receive the lower gripper jaw. Beside this or additionally the table can have in the feed area lifting cylinders mounted in said feed area, the piston rods of which can be extended from the table and, with an appropriate positioning of the stack to be cut, thus lift said stack in the edge region so that the lower gripper jaw can be moved below the stack.

A particular embodiment of the invention finally provides for the table to be fitted with at least one lateral stop, which can be lowered or folded below the table surface, for aligning the product to be cut. It is thus possible even to turn such stacks on the feed area of the device, the diagonal dimension of which stacks is greater than the width of the feed area and consequently, during turning, protrude over the lateral boundary of the feed area in the region of their corner.

Further features of the invention are illustrated in the description of the figures and in the subclaims, it being noted that all the individual features and all the combinations of individual features are essential to the invention.

The invention is illustrated diagrammatically in the figures with reference to several embodiments by way of example without being restricted to the latter.

Figure 2:
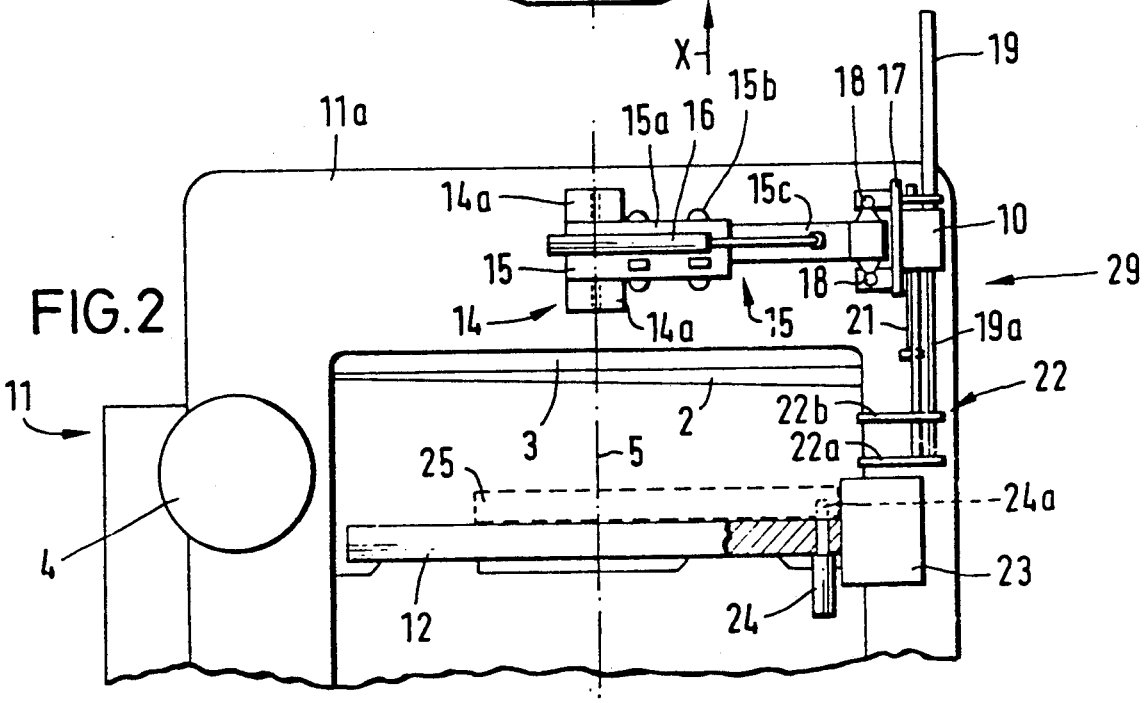
Figure 3:
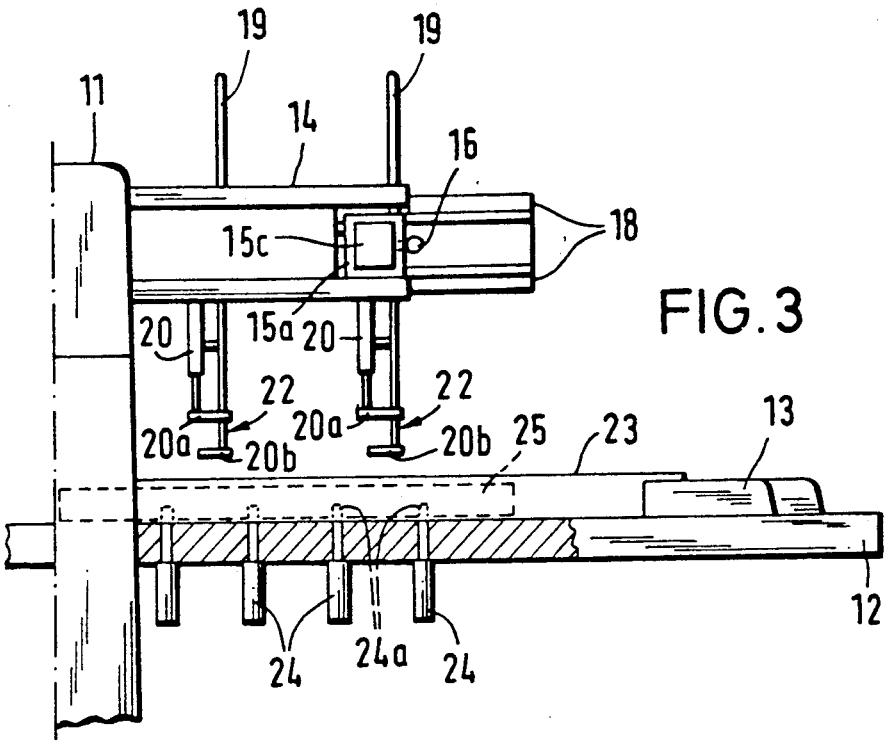
Figure 4:
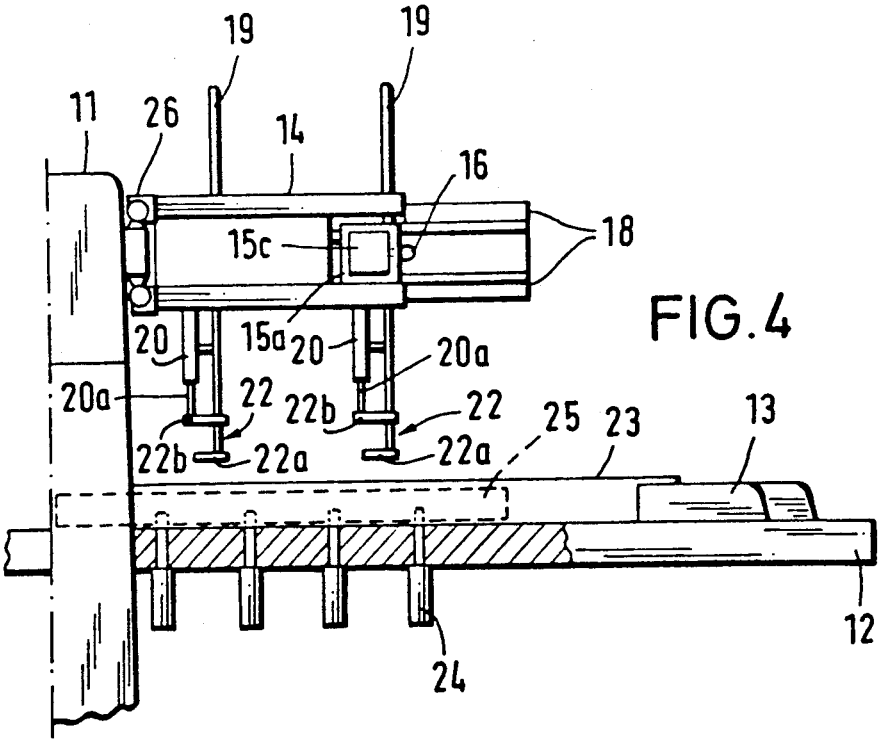
Figure 5:
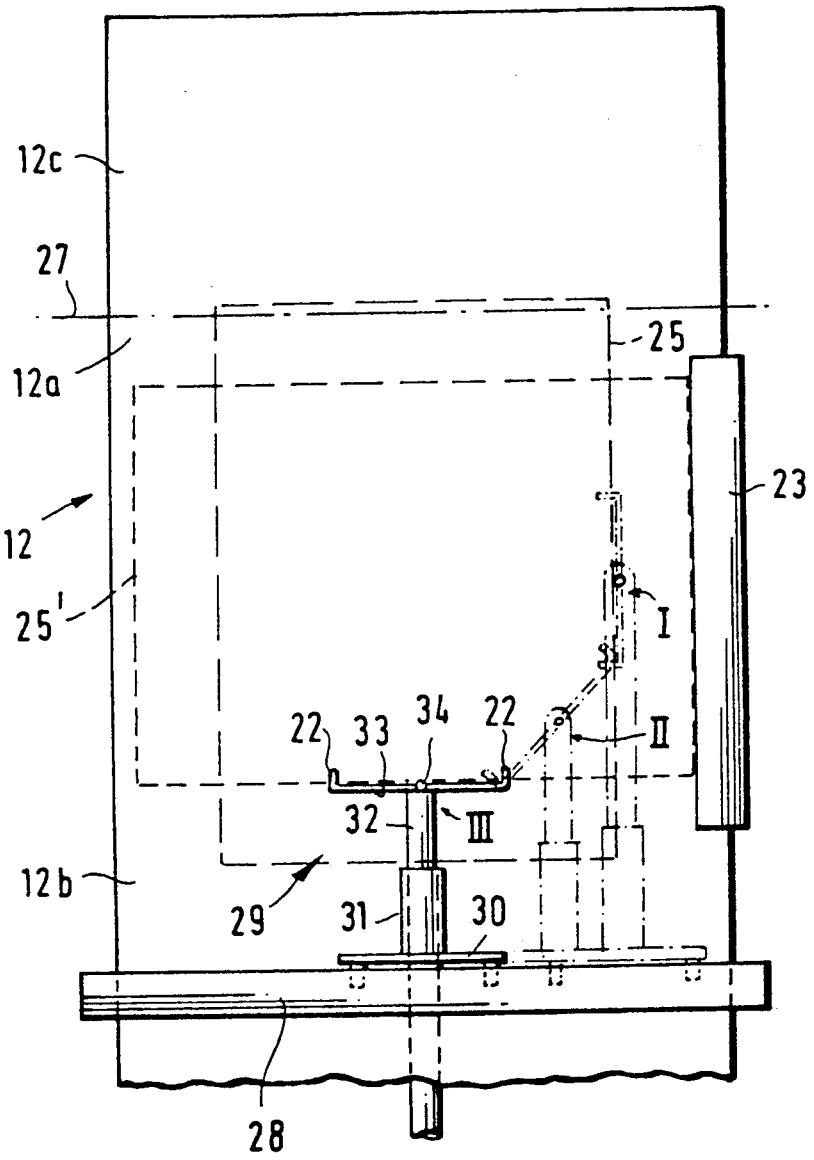
Figure 6:
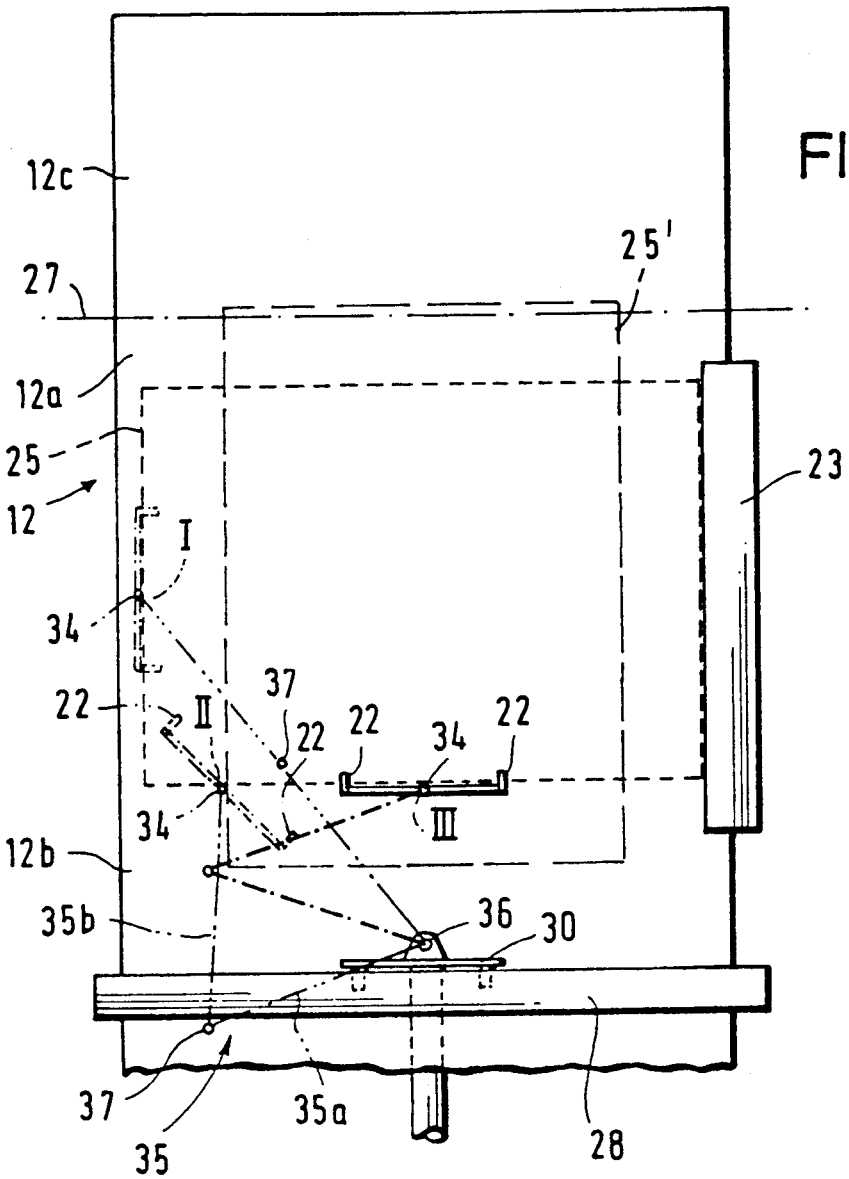
Figure 7:
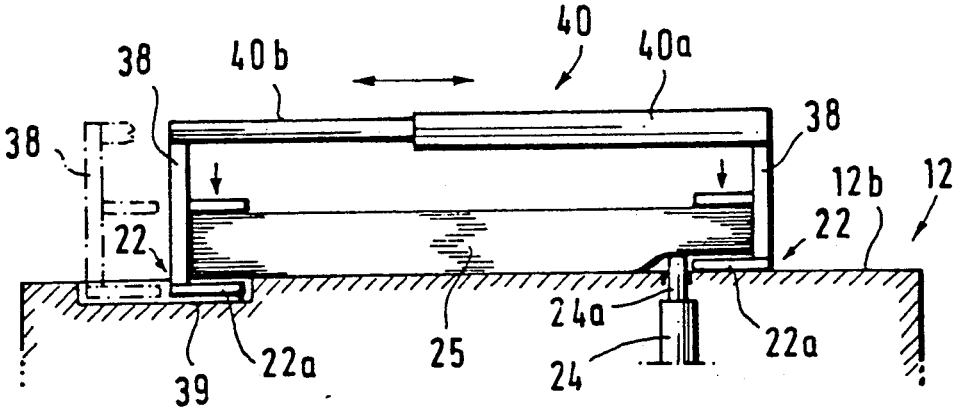

FIG. 1 illustrates a first embodiment of the device according to the invention in a diagrammatic view, shown in a plan view, FIG. 2 illustrates a view X according to FIG. 1 of the upper region of the device, FIG. 3 illustrates a view Y according to FIG. 1 of the upper region of the device, FIG. 4 is an illustration according to FIG. 3 of a slightly modified mounting of the gripper system, FIG. 5 is a diagrammatic illustration of a second embodiment of the device according to the invention, shown in a plan view FIG. 6 is a diagrammatic illustration of a third embodiment of the device according to the invention, shown in a plan view, and FIG. 7 is a principle illustration of a gripper formed from two pairs of gripper tongs.

The device described in the figures refers to a paper-cutting machine forming one structural unit. As described with regard to the first embodiment according to FIGS. 1 to 4, this has in a known manner a table 12, the surface of which has an operating area 12*a*, above which there is a cutting blade 2 and a pressing beam 3, behind that a feed area 12*b* to receive the product 25 or 25' to be cut and in front an output area 12*c* to receive the cut product (not shown in detail). Serving for the displacement of the product to be cut is a spindle-driven forward feed saddle 13 which can be displaced in the longitudinal extension of the table 12 over the feed area 12*b*. Additionally, the figures show the machine stand 11 of the paper-cutting machine, the portal 11*a* of which is arranged above the table 12 and receives on its underside the cutting blade 2 and the pressing beam 3. Reference numeral 4 denotes an electric motor flanged onto the machine stand 11 for driving the paper-cutting machine 1.

As can be seen from the illustration of FIGS. 1 to 3, a gripper system 29 is connected to the portal 11*a*. In detail, a projecting first support 14 is flanged onto the portal 11*a* on the side facing the feed area 12*b*. Said support extends perpendicular to the portal 11*a* in the plane of symmetry 5 of the table 12 almost up to the table centre. The free end of the support 14 is fitted with brackets 14 which are arranged parallel to each other and are penetrated by a bolt 6 oriented perpendicular to the feed area 12*b*. A second support 15 can be swivelled about the bolt 6 between the brackets 14, which support can be retained via retaining means (not shown in detail) in a first position shown in FIGS. 1 to 3 parallel to the portal 11*a* and in a second position swivelled away from the portal 11*a* at a right-angle to said first position (double arrow A in FIG. 1). The support 15 is of two-part construction, a first tubular support element 15*a* is connected to the free end of the support 14 and fitted with guide rollers 15*b* for a further support element 15*c* which is displaceable in the longitudinal direction of the support element 15*a*. Engaging on the support 14 and on the support element 15*a* is a pneumatically driven swivel cylinder 7, by means of which the support element 15*a* can be swivelled from the position at right-angles to the support 14 into the extended position. Arranged between the support element 15*a* and the support element 15*c* is a pneumatically acting cylinder 16 which serves for extending and retracting the support element 15*c*. The structural dimensions relating to the second support 15*c* are such that it is possible to retract it as far as possible, but on the other hand also to extend it so far that it projects over the lateral edge 12*d* of the table 12, and extends, on the other hand, up to the forward feed saddle 13 in the extended position.

The support element 15*c* has in the region of its free end upper and lower guides 18 extending perpendicular to the longitudinal extension of said support element and parallel to the feed area 12*b*, in which guides a gripper support plate 17 is displaceably mounted. The displacement of the gripper support plate 17 takes place via a further pneumatic cylinder 8 which, on the one hand, engages on the support element 15*c* and, on the other hand, on a bearing ring 9 of the gripper support plate 17. The length of the guides 18 is dimensioned such that the gripper support plates 17—in relation to the illustration of FIG. 1—can be moved between a position adjacent to the portal 11*a* and a position symmetrical to the centre of the feed area. Connected to the gripper support plate 17 are two spaced-apart gripper receptacles 10. Each has a receptacle extending perpendicular to the feed area 12*b*, which receptacle is penetrated by a guide rod 21 which, in turn, receives at its lower end a pair of gripper tongs 22. Mounted, furthermore, in each gripper receptacle 10 is a pneumatic lifting cylinder 19 which engages on the gripper tongs 22. The gripper tongs 22 have a lower gripper jaw 22*a* which is fixedly connected to the lower end of the guide rod 21 and the piston rod 19*a* of the lifting cylinder 19. An upper pair of gripper tongs 22*b* is provided with two boreholes (not shown in detail) which are penetrated in a guiding manner by the guide rod 21 and the piston rod 19*a*, a further pneumatic lifting cylinder 20, connected to the guide rod 21 above the upper gripper jaw 22*b*, engages with its piston rod 20*a* on the upper gripper jaw 22*b*. Thus the lifting cylinder 20 permits the upper gripper jaw 22*b* to move in relation to the relatively stationary lower gripper jaw 22*a* and thus to grip and release the product 25 to be cut.

It can additionally be seen from FIGS. 1 and 2 that the paper-cutting machine 1 has in the region of the left lateral edge 12*d* of the feed area 12*b* a lowerable lateral ruler 23. Mounted below the table 12 adjacent to this lateral ruler 23 are several lifting cylinders 24 each at the same distance from the lateral edge 12*d*, the piston rods 24*a* of which lifting cylinders penetrate passage boreholes (not denoted in detail) in the feed area 12*b* of the table 12 and, when the piston rods 24*a* are extended, as is shown in particular in FIG. 2, project beyond the surface of the table 12.

The device described thus far operates as follows: after edge trimming of the narrow edge 25*a* of the product 25 to be cut, the narrow edge 25*a* is situated in the cutting plane 27 of the blade and the longitudinal edge 25*b* of the product 25 to be cut rests against the lateral ruler 23. The forward feed saddle 13 is moved into the retracted end position shown in FIG. 1, then the piston rods 24*a* of the lifting cylinders 24 are extended to the extent that the product 25 to be cut can be gripped from below by means of the lower gripper jaw 22*a*. Firstly the two grippers 22 are moved so far downwards until the lower gripper jaw 22 is on the same level as the gap between the product 25 to be cut and the table 12. The upper gripper jaw 22*b* has been moved away from the lower gripper jaw 22*a* to correspond to the stack thickness. Then the support element 15*c* is retracted so far into the support element 15*a* until both pairs of gripper tongs 22 completely enclose the stack 25 to be cut. Depending on the length of the stack to be cut, it may be necessary to displace the grippers along the guides 18 prior to introduction into the stack so that it is ensured that the gripper tongs 22 are positioned symmetrically to the assigned axis of symmetry of the stack 25 to be cut. After closing the gripper tongs 22 by lowering the gripper jaw 22*b* onto the stack 25, the piston rods 24*a* of the lifting cylinders 24 are retracted. In order to provide the required swivelling space for the product 25 to be cut, the support element 15*c* is then partially retracted into the support element 15*a* so that the stack 25 comes to rest approximately symmetrically to the longitudinal axis of the table. Then the retaining mechanism situated in the region of the bolt 6 is released and the support 15 is swivelled by 90°, air jets (not explained in detail) arranged in the table in the region of the feed area thereby reducing the friction between the stack and the table. In this position, the support 15 forms a straight line with the support 14, in which line the two supports 14 and 15 are again engaged with each other. During the swivel movement of the support 15, the extension of the support element 15*c* out of the support element 15*a* and the moving of the gripper support plate 17 in the guides 18 already expediently take place so that the product to be cut comes to rest adjacent to the lateral edge 12*d* of the table on completion of the swivel movement and the longitudinal side 25*c* is positioned on the feed area 12*b* at a slight distance from the cutting plane 27 of the blade. The lowerable lateral ruler 23 is then again transferred into the extended position shown in FIGS. 2 and 3 and the now turned stack 25' of the product to be cut is placed by slight moving of the gripper support plate 17 in the guides completely against the lateral stop. After release, the gripper tongs 22 are moved out of the stack 25' and the support 15 is again swivelled into the position shown in FIG. 1. By means of the forward feed saddle 13, the product 25' to be cut can then be advanced under the cutting blade 2 up to the desired cutting plane. After pressing down by the pressing beam 3, the cut then takes place. The next edge trimming follows in the sequence of operation described. The structure described above of the device according to the invention not only permits turning, in particular by a right-angle, of the product 25 or 25' to be cut, but the gripper system can also take over the function of the forward feed saddle. Namely, in the extended position of supports 14 and 15, the gripper tongs 22 grip the product 25 or 25' to be cut at the rear edge and the product to be cut can thus be advanced by retraction of the support element 15*c* in to the support element 15*a*, or withdrawn in the case of an opposite movement. Moreover, it is, of course, possible in an appropriate constructional development of the device not only to swivel the support 15 by an angle of 90° out of the position shown in FIG. 1, but also by an angle of 180° so that further edge trimming can be undertaken without the gripper tongs 22 having to be released.

FIG. 4 shows a slight modification of the paper-cutting machine described thus far in FIGS. 1 to 3. In the latter, the support 14 is mounted so as to be displaceable parallel to the longitudinal extension of the cutting blade 2 and pressing beam 3 in guides 26 extending over the entire length of the portal 11*a*. The support 14 is displaced by means of a pneumatic cylinder which is not visible in this view. The displaceability of the support allows, for example, a stack to be removed from peripheral equipment or discharged to such equipment.

FIGS. 5 and 6 show principle illustrations of further embodiments of a paper-cutting machine 1 having a table subdivided correspondingly into operating area 12*a*, feed area 12*b* and output area 12*c* as well as the cutting plane 27 of the blade. Provided parallel to the cutting plane 27 of the blade behind the table is a guide 28, in which a similar gripper system 29 is displaceable. A base plate 30 of the gripper system is displaceable in the guide 28, a first support 31 directed towards the cutting plane 27 of the blade is connected fixedly to said base plate. In accordance with the function of supports 14 and 15 according to the first embodiment, a second support 32 is mounted displaceably in the support 31. The free end of the support 32 receives a gripper support plate 33 which can be swivelled about an axle 34 orientated perpendicular to the feed area 12*b*. The power means to move the base plate 30, to extend the support 32 and to swivel the gripper support plate 33 are not explained in the figures. The gripper support plate 33 corresponds in its structure and its function to the gripper support plate 17 according to the embodiment described previously, two pairs of gripper tongs being mounted in said gripper support plate so as to be displaceable parallel to the plane of the feed area 12*b* and perpendicular to the latter corresponding to the embodiment mentioned. In the embodiment described in FIG. 5, after gripping the turning of the product 25 to be cut takes place by a superimposition of the displacing movement of the base plate 30 with the extension or retraction movement of the support 32 and the swivel movement of the gripper support plate 33. I shows the product 25 to be cut which has been gripped laterally with the support 32 extended and the gripper support plate 33 lying flush with the support 32. II shows an intermediate position with partially retracted support 32 and gripper support plate 33 swivelled by an angle of 45° in relation to the extended starting situation. III shows the product 25' to be cut turned by 90° with the support 32 largely retracted and the gripper support plate 33 swivelled by 90°. The retraction movement of the support 32 and the swivel movement of the gripper support plate 33 between operating conditions I and III is superimposed by a displacing movement of the base plate 30. After reaching the turned position, the product 25' to be cut can be placed by defined movement of the base plate 30 and the support 32 against the assigned lateral ruler 23 next to the cutting plane 27 of the blade. The defined forward feed of the product 25' to be cut to the separation point can then take place after the gripper system 29 has been moved out of the region of the forward feed saddle 13 by the latter. As described concerning the previous embodiment, the gripper system 29 can replace the forward feed saddle 13 and thus serve for the displacement of the product to be cut, by the swivellable mounting of the gripper support plate 33 the latter can additionally execute the functions of a swivelling saddle.

FIG. 6 explains with reference to a further embodiment that the telescopic supports 31 and 32 described concerning the embodiment according to FIG. 5 can also be replaced by a two-part knuckle joint 35. For example, a lever part 35*a* can be swivelled about an axle 36 of the displaceable base plate 30, which axle is oriented perpendicular to the table 12 and arranged behind the feed area 12*b*. With the end of the lever part 35*a* facing away from the axle 36, a lever part 35*b* can be swivelled about an axle 37 arranged parallel to the axle 36, the end of the level part 35*b* facing said axle in turn receives the gripper support plate 33 which can be swivelled about an axle 34 arranged parallel to the axle 37. In accordance with the embodiment according to FIG. 5, the gripper support plate 33 in turn receives two pairs of gripper tongs which are displaceable in the plane of the table and perpendicular thereto. The power means for swivelling the knuckle joint 35 in total and additionally the lever parts 35*a* and 35*b* as well as the gripper support plate 33 are not explained in the drawing of FIG. 6. I shows the product 25 to be cut which is gripped at the side with knuckle joint 35 extended. II shows the stack to be cut in a partially turned position, in which the knuckle joint 35 is partially bent and the gripper support plate 33 is swivelled out of the starting position by an angle of 45°. III shows a further bent knuckle joint 35 with the gripper support plate 33 swivelled by 90° out of the starting position and thus the product 25' to be cut turned by 90°. During the turning of the product to be cut, the swivel movement of the gripper support plate 33 and the knuckle joint 35 can be superimposed by a displacement movement of the base plate 30 in order to place the product 25' to be cut against a lateral stop again. Within the framework of this embodiment it is conceivable to construct the lever parts 35*a*/35*b* so as to be variable in length, the variation in length in turn taking place via power means.

FIG. 7 shows a variant of a gripper system constructed as a clamping beam 40. The clamping beam 40 has a first beam part 40*a* which is attached to the gripper support plates 17 and 33 described above and in which a further beam part 40*b* is mounted so as to be displaceable in the longitudinal direction via adjustment means (not shown in detail). Two downwardly directed brackets 38 of the clamping beam 40 are provided with the gripper tongs 22 described above. The two pairs of gripper tongs 22 are directed towards each other and thus permit gripping on both sides of the product 25 to be cut. FIG. 7 shows, on the right, a lifting cylinder 24 with an extended piston rod 24*a* and, on the left, the feed area 12*b* of the table 12 is fitted instead for another variant with a trough region 39 into which the lower gripper jaw 22*a* can be inserted so that separate lifting of the product 25 to be cut in the gripper region is not required.

I claim:

1. Device for cutting stacked product in sheet form having a table, the surface of which has an operating area, above which there is a cutting blade and a pressing beam, on one side of the operating area is a feed area to receive the product to be cut and on a side opposite said one side of the operating area is an output area to receive the cut product, said operating area having a forward feed apparatus for the product to be cut, wherein a gripper system (29) is provided in the region of the feed area (12*b*) for turning the product (25) to be cut in the plane of the table surface, wherein the gripper system (29) has at least one pair of gripper tongs (22) which are displaceable perpendicular to the table surface, and movable in a gripping plane oriented parallel to the table surface.

2. Device according to claim 1, characterized in that said device has a first support (14) projecting over the feed area (12*b*), said first support having a free end which receives a second support (15) which can be swivelled parallel to the table surface and which, in turn, receives the gripper tongs (22) so as to be displaceable perpendicular to the table surface.

3. Device according to claim 2, characterized in that the projecting support (14) is displaceable parallel to the longitudinal extension of the cutting blade (2) and the pressing beam (3).

4. Device according to claim 2, characterized in that the projecting support (14) is stationary.

5. Device according to claim 4, characterized in that the projecting support (14) is connected to a stand (11) receiving the cutting blade (2) and the pressing beam (3).

6. Device according to claim 4, characterized in that the projecting support (14) is connected to a stand (28, 30) arranged behind or next to the feed area (12*b*).

7. Device according to claim 4, characterized in that the table (12) is fitted with at least one lateral stop (23), which can be lowered or folded under the table surface, for aligning the product (25) to be cut.

8. Device according to claim 2, characterized in that, said second support (15) receives guides (18) having free ends, said guide free ends receive a gripper support (17, 10) which is displaceable perpendicular to a length of said second support and parallel to the table surface, in which gripper support a lifting element (19) is mounted, to which the gripper tongs (22) are connected.

9. Device according to claim 8, characterized in that the projecting support (14) is displaceable parallel to a longitudinal extension of the cutting blade (2) and the pressing beam (3).

10. Device according to claim 8, characterized in that the table (12) has lifting cylinders (24) mounted in the feed area (12*b*), (24*a*) said lifting cylinders having piston rods which can be extended from the table (12).

11. Device according to claim 8, characterized in that the projecting support (14) is stationary.

12. Device according to claim 8, characterized in that the gripper tongs (22) have a lower gripper jaw (22*a*) which is stationary relative to said gripper tongs and an upper gripper jaw (22*b*) which is displaceable relative to said gripper tongs perpendicular to the table surface by a lifting element, in particular a lifting cylinder (20).

13. Device according to claim 12, characterized in that the table (12) has in the feed area (12*b*) a trough (39) to receive the lower gripper jaw (22*a*).

14. Device according to claim 8, characterized in that two pairs of gripper tongs (22), which are arranged spaced apart, are connected to the gripper support (10, 17).

15. Device according to claim 14, characterized in that the projecting support (14) is stationary.

16. Device according to claim 14, characterized in that the projecting support (14) is displaceable parallel to a longitudinal extension of the cutting blade (2) and the pressing beam (3).

17. Device according to claim 14, characterized in that the projecting support (14) is connected to a stand (11) receiving the cutting blade (2) and the pressing beam (3).

18. Device according to claim 14, characterized in that the projecting support (14) is connected to a stand (28, 30) arranged behind or next to the feed area (12*b*).

19. Device according to claim 14, characterized in that the first and the second support (14, 15) form a knuckle joint (35).

20. Device according to claim 14, characterized in that the table (12) is fitted with at least one lateral stop (23), which can be lowered or folded under the table surface, for aligning the product (25) to be cut.

21. Device according to claim 2, characterized in that the first and the second support (14, 15) form a knuckle joint (35).

22. Device according to claim 2, characterized in that the second support (15) is constructed so as to be variable in length.

23. Device according to claim 22, characterized in that the projecting support (14) is displaceable parallel to a longitudinal extension of the cutting blade (2) and the pressing beam (3).

24. Device according to claim 22, characterized in that the first and the second support (14, 15) form a knuckle joint (35).

25. Device according to claim 22, characterized in that the projecting support (14) is stationary.

26. Device according to claim 25, characterized in that the projecting support (14) is connected to a stand (11) receiving the cutting blade (2) and the pressing beam (3).

27. Device according to claim 25, characterized in that the projecting support (14) is connected to a stand (28, 30) arranged behind or next to the feed area (12*b*).

28. Device according to claim 25, characterized in that the table (12) is fitted with at least one lateral stop (23), which can be lowered or folded under the table surface, for aligning the product (25) to be cut.

29. Device according to claim 22, characterized in that, said second support (15) receives guides (18) having free ends, said guide free ends receive a gripper support (17, 10) which is displaceable perpendicular to a length of said second support and parallel to the table surface, in which gripper support a lifting element (19) is mounted, to which the gripper tongs (22) are connected.

30. Device according to claim 29, characterized in that two pairs of gripper tongs (22), which are arranged spaced apart, are connected to the gripper support (10, 17).

31. Device according to claim 30, characterized in that the projecting support (14) is connected to a stand (28, 30) arranged behind or next to the feed area (12*b*).

32. Device according to claim 30, characterized in that the projecting support (14) is stationary.

33. Device according to claim 30, characterized in that the first and the second support (14, 15) form a knuckle joint (35).

34. Device according to claim 30, characterized in that the table (12) is fitted with at least one lateral stop (23), which can be lowered or folded under the table surface, for aligning the product (25) to be cut.

35. Device according to claim 30, characterized in that the projecting support (14) is displaceable parallel to a longitudinal extension of the cutting blade (2) and the pressing beam (3).

36. Device according to claim 30, characterized in that the projecting support (14) is connected to a stand (11) receiving the cutting blade (2) and the pressing beam (3).

37. Device according to claim 29, characterized in that the table (12) has lifting cylinders (24) mounted in the feed area (12*b*), (24*a*) said lifting cylinders having piston rods which can be extended from the table (12).

38. Device according to claim 29, characterized in that the projecting support (14) is stationary.

39. Device according to claim 29, characterized in that the gripper tongs (22) have a lower gripper jaw (22*a*) which is stationary relative to said gripper tongs and an upper gripper jaw (22*b*) which is displaceable relative to said gripper tongs perpendicular to the table surface by a lifting element, in particular a lifting cylinder (20).

40. Device according to claim 39, characterized in that the table (12) has in the feed area (12*b*) a trough (39) to receive the lower gripper jaw (22*a*).

41. Device according to claim 29, characterized in that the projecting support (14) is displaceable parallel to a longitudinal extension of the cutting blade (2) and the pressing beam (3).

42. Device according to claim 29, characterized in that the lifting element (19) is constructed as a lifting cylinder.

43. Device according to claim 42, characterized in that the table (12) has lifting cylinders (24) mounted in the feed area (12*b*), (24*a*) said lifting cylinders having piston rods which can be extended from the table (12).

44. Device according to claim 42, characterized in that the projecting support (14) is stationary.

45. Device according to claim 42, characterized in that the projecting support (14) is displaceable parallel to a longitudinal extension of the cutting blade (2) and the pressing beam (3).

46. Device according to claim 42, characterized in that the gripper tongs (22) have a lower gripper jaw (22*a*) which is stationary relative to said gripper tongs and an upper gripper jaw (22*b*) which is displaceable relative to said gripper tongs perpendicular to the table surface by a lifting element, in particular a lifting cylinder (20).

47. Device according to claim 46, characterized in that the table (12) has in the feed area (12*b*) a trough (39) to receive the lower gripper jaw (22*a*).

* * * * *

UNITED STATES PATENT AND TRADEMARK OFFICE

CERTIFICATE OF CORRECTION

PATENT NO. : 5,127,294
DATED : July 7, 1992
INVENTOR(S) : Wolfgang Mohr

It is certified that error appears in the above-indentified patent and that said Letters Patent is hereby corrected as shown below:

Column 7, Claim 1, line 67, delete "said operating area" and insert in its place --said device--.

Signed and Sealed this

Nineteenth Day of October, 1993

Bruce Lehman

*Attest:*

BRUCE LEHMAN

*Attesting Officer*

*Commissioner of Patents and Trademarks*